US006736240B2

(12) United States Patent
Dürr et al.

(10) Patent No.: US 6,736,240 B2
(45) Date of Patent: May 18, 2004

(54) LUBRICATION MECHANISM FOR A CAM DRIVE

(75) Inventors: Bernhard Dürr, Stuttgart (DE); Harald Schliemann, Waiblingen (DE); Manfred Rabis, Schorndorf (DE); Jörg Schlossarczyk, Winnenden (DE)

(73) Assignee: Andreas Stihl AG & Co. (DE)

( * ) Notice: Subject to any disclaimer, the term of this patent is extended or adjusted under 35 U.S.C. 154(b) by 77 days.

(21) Appl. No.: 09/944,764

(22) Filed: Aug. 31, 2001

(65) Prior Publication Data

US 2002/0027046 A1 Mar. 7, 2002

(30) Foreign Application Priority Data

Sep. 1, 2000 (DE) ..... 100 43 592

(51) Int. Cl.[7] ..... F01M 1/00
(52) U.S. Cl. ..... 184/6.9; 184/11.1; 123/90.33
(58) Field of Search ..... 184/6.9, 11.1, 184/11.2, 11.3, 11.4, 11.5, 13.1, 6.12; 123/90.33, 90.34

(56) References Cited

U.S. PATENT DOCUMENTS

| | | | | | |
|---|---|---|---|---|---|
| 2,718,219 | A | * | 9/1955 | Chayne et al. | 123/90.42 |
| 3,045,658 | A | * | 7/1962 | Sampietro | 123/90.42 |
| 3,590,791 | A | * | 7/1971 | Roosa | 123/79 R |
| 3,667,434 | A | * | 6/1972 | Sandusky | 123/90.35 |
| 4,062,335 | A | * | 12/1977 | Rank | 123/501 |
| 4,182,288 | A | * | 1/1980 | Thauer | 123/78 AA |
| 4,297,089 | A | * | 10/1981 | Giardini | 417/437 |
| 4,343,270 | A | * | 8/1982 | Kawabe | 123/196 V |
| 4,369,740 | A | * | 1/1983 | Seidl | 123/90.45 |
| 4,404,936 | A | * | 9/1983 | Tatebe et al. | 123/196 R |
| 4,418,659 | A | * | 12/1983 | Gaede | 123/90.46 |
| 4,424,772 | A | * | 1/1984 | Porter | 123/65 VB |
| 4,450,799 | A | * | 5/1984 | Zeilinger | 123/90.53 |
| 4,732,237 | A | * | 3/1988 | Nakano | 184/6.5 |
| 4,741,303 | A | * | 5/1988 | Kronich | 123/192.2 |
| 4,834,219 | A | * | 5/1989 | Inagaki et al. | 184/6.5 |
| 4,879,974 | A | * | 11/1989 | Alvers | 123/51 A |
| 5,119,773 | A | * | 6/1992 | Schon et al. | 123/90.16 |
| 5,143,033 | A | * | 9/1992 | Catterson et al. | 123/195 R |
| 5,492,086 | A | | 2/1996 | Kuhns | |
| 5,522,477 | A | * | 6/1996 | Byrne | 184/6.12 |
| 5,540,054 | A | * | 7/1996 | Bullivant | 60/598 |
| 5,553,583 | A | * | 9/1996 | Jones | 123/90.34 |
| 5,588,408 | A | * | 12/1996 | Kurihara | 123/196 W |
| 5,988,129 | A | * | 11/1999 | Prior et al. | 123/90.34 |
| 6,098,583 | A | * | 8/2000 | Gordon | 123/90.38 |
| 6,135,241 | A | * | 10/2000 | Ganguly et al. | 184/11.1 |
| 6,199,532 | B1 | | 3/2001 | Häberlein et al. | 123/196 R |

FOREIGN PATENT DOCUMENTS

| | | |
|---|---|---|
| DE | 30 22 901 | 12/1981 |
| DE | 34 38 031 | 4/1986 |
| DE | 19848890 A1 | 4/2000 |

OTHER PUBLICATIONS

Patent Abstracts of Japan, 07034838, published Feb. 3, 1995.
Patent Abstracts of Japan, 08042352, published Feb. 13, 1996.

* cited by examiner

*Primary Examiner*—David A. Bucci
*Assistant Examiner*—Julie K. Smith
(74) *Attorney, Agent, or Firm*—R W Becker & Associates; R W Becker

(57) ABSTRACT

A cam drive is provided for a valve control of a mixture-lubricated internal combustion engine that has a cylinder, and a cylinder head in which is disposed a poppet valve which is actuated by a pivotable rocker arm. Mounted in a cam chamber is a control cam that is driven by the crankshaft of the engine and on the cam path of which rests a drag lever that transfers the cam lift to the rocker arm. To achieve a reliable mixture lubrication, a flow guidance element is disposed in the annular chamber between the peripheral wall of the cam chamber and the maximum diameter of the path of a cam nose. The flow guidance element is provided with a flow edge that is disposed adjacent to the drag lever in the vicinity of the path diameter of the cam nose.

18 Claims, 4 Drawing Sheets

LUBRICATION MECHANISM FOR A CAM DRIVE

BACKGROUND OF THE INVENTION

The present invention relates to a cam drive for a valve control in a valve-controlled internal combustion engine, especially in a mixture-lubricated internal combustion engine.

A mixture-lubricated, valve-controlled internal combustion engine is disclosed in DE 198 48 890 A1. The mixture is supplied to the internal combustion engine in the cylinder via an intake passage that is controlled by an intake valve. To lubricate the moving parts of the engine, the valve chamber communicates with the intake passage via a connection opening, whereby the crankcase is connected to the valve chamber via a further flow connection. This flow connection can be provided by the cam drive, since the latter is driven by the crankshaft and the poppet valves that are disposed in the cylinder heads must be actuated. In this connection, the pressure pulses in the intake passage are adequate to supply mixture to the chambers that are connected only via the connection opening.

For the correct control of the poppet valves in terms of time, control cams having cam noses are provided and are rotatably driven by the crankshaft. Due to the high speeds of such small-volume internal combustion engines, a lack of lubricant can occur, especially in the region of the control cams. Due to the great circumferential speeds of the control cams, a tractive flow that rotates about the axis of rotation of the cams can form in the cam chamber, so that the lubricating oil particles that are carried along in the mixture are displaced outwardly away from the lubricating locations. The lack of lubricating oil caused thereby leads to premature wear.

It is therefore an object of the present invention to improve the known cam drive in such a way that even at high and maximum speeds of the internal combustion engine, a reliable lubrication of the cam drive is ensured.

BRIEF DESCRIPTION OF THE DRAWINGS

This object, and other objects and advantages of the present invention, will appear more clearly from the following specification in conjunction with accompanying schematic drawings, in which.

SUMMARY OF THE INVENTION

Figure 1:
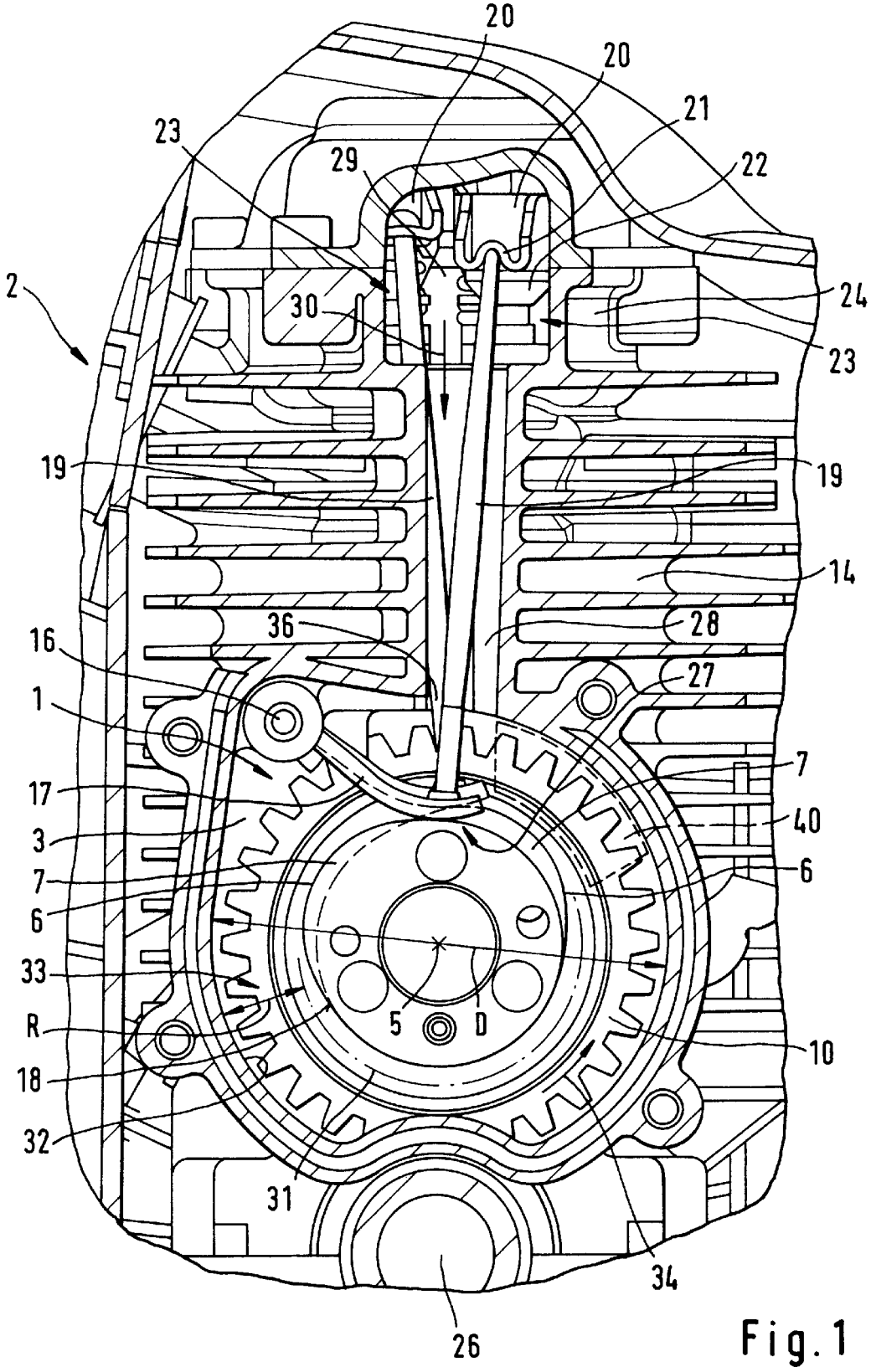
FIG. 1 is a view of a cam drive of a valve-controlled, mixture-lubricated internal combustion engine.

The present invention provides a cam drive for a valve control in a valve-controlled internal combustion engine having a cylinder and a cylinder head in which is disposed a poppet valve that is actuated by a pivotable rocker arm, wherein a control cam is rotatably driven, in a cam chamber, by a crankshaft of the internal combustion engine, and wherein resting on the cam surface of the control cam is a drag lever that transfers cam lift to the rocker arm, the cam drive further comprising a flow guidance element that is disposed in an annular chamber that is provided between the peripheral wall of the cam chamber and the maximum diameter of the path of a cam nose of the control cam, wherein a flow edge is formed on the flow guidance element and is disposed adjacent to the drag lever and in the vicinity of the maximum diameter of the path of the cam nose.

By providing the flow guidance element, which is disposed in the annular chamber between the peripheral wall of the cam chamber and the maximum diameter of the path of the cam nose of the control cam, a tractive flow that is formed is disrupted, whereby lubricating oil droplets on the flow guidance element are deposited. These droplets are forced by the passing flow to the flow edge, which is disposed adjacent to the drag lever and in the vicinity of the maximum path diameter of the cam nose. Lubricating oil droplets that are dislodged from the flow edge are in this connection supplied by gravity or guided partial streams to the lubricating locations.

The flow guidance element preferably blocks the annular chamber in the direction of rotation of the control cams, so that essentially the entire tractive flow is diverted toward those regions of the cam drive that are to be lubricated. For this purpose, the flow guidance element can have a deflection surface that extends in a curved manner from the peripheral wall of the cam chamber to the path diameter of the cam nose. In this connection, the deflection surface is disposed essentially parallel to the axis of rotation of the control cam, and ends at the flow edge that delimits a gap between the flow guidance element and the path of the cam. The mixture stream that rotates in the cam chamber is forced into the gap in a directed manner by means of the deflection surface, whereby due to the selected position of the flow edge upstream of the drag lever when viewed in the direction of rotation, the mixture stream strikes the surface of the cam directly in the contact region of the drag lever. Even at high speeds, a reliable lubrication is consistently ensured.

It can be expedient to dispose a flow disruption element in front of where a protective conduit that surrounds the push rods opens into the cam chamber, in order to directly deflect the oil laden mixture stream, which enters axially relative to the axis of rotation of the cams, in a direction toward the lubricating locations during the entry. In this connection, the flow disruption element is disposed between the drag lever and the opening, and extends from the peripheral wall of the cam chamber radially inwardly at an angle in a direction toward the flow guidance element. The flow guidance element has a further deflection surface with a flute into which extends the edge of the flow disruption element. Due to the presence of the flow disruption element, which is provided as an inclined plane, deposited lubricating oil flows off in a direction toward the flute of the further deflection surface and is guided along this deflection surface to the flow edge. Due to the directed supply of flow to the deflection surfaces of the flow guidance element, to an increased extent lubricating oil droplets are deposited that all move to the flow edge and serve for the lubrication of the moving parts.

Further specific features of the present invention will be described in detail subsequently.

DESCRIPTION OF PREFERRED EMBODIMENTS

Figure 2:
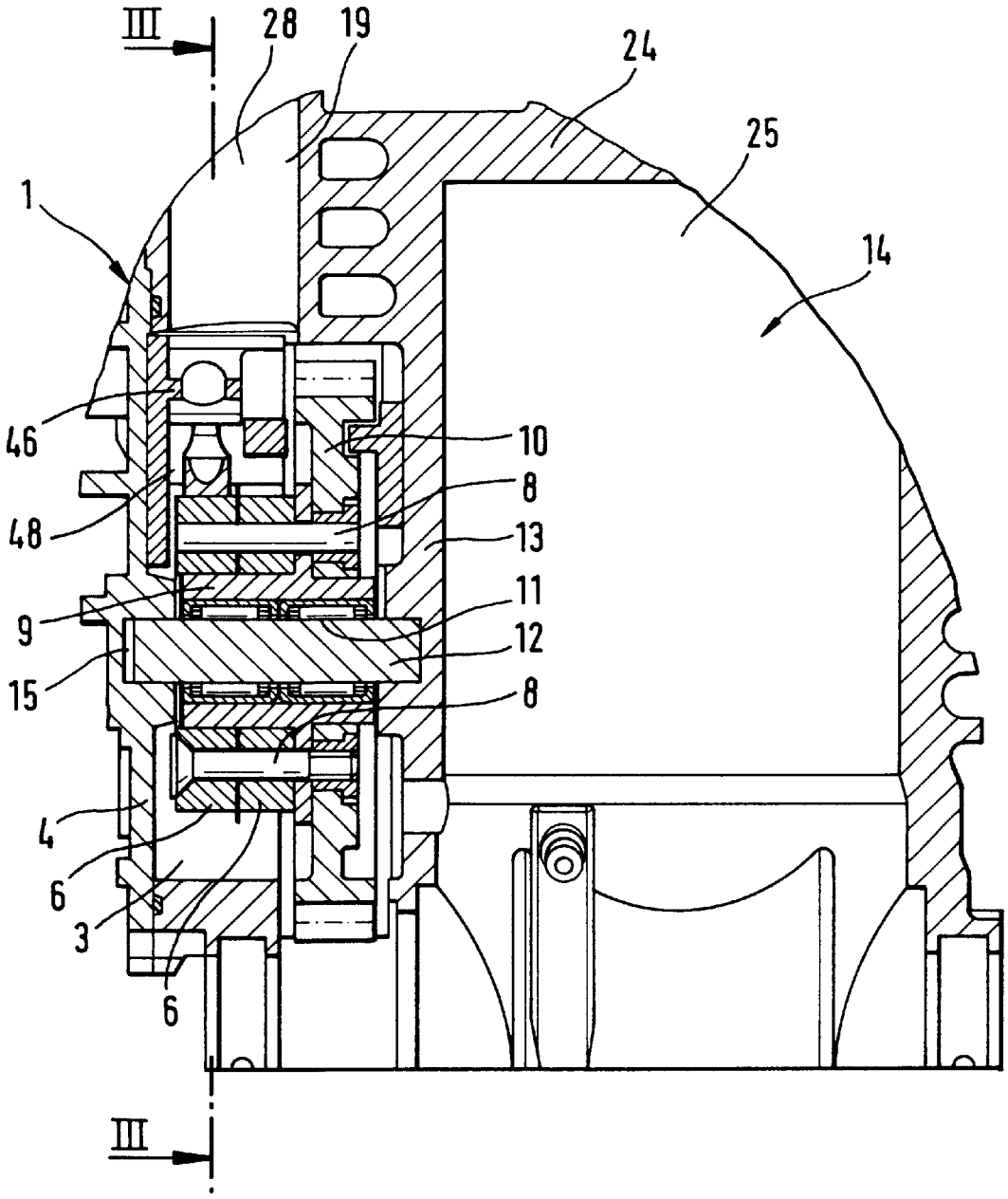
FIG. 2 is a cross-sectional view of one exemplary embodiment of an inventive cam drive having a flow guidance element disposed in the cam chambers.

Referring now to the drawings in detail, the partial illustration of FIG. 1 of an internal combustion engine 2 includes a cam drive 1 that is disposed in a cam chamber 3. The cam chamber has a circular-like configuration, and it is closed off on one side by a cam chamber cover 4 (see FIG. 2). Mounted in the cam chamber 3 are sequence switch or control cams 6 that are rotatable about an axis 5 and that are each provided with a cam nose 7. As shown in FIG. 2, the cams 6 are fixedly secured on a common hub 9 by keys 8. By means of the keys 8, the cam drive wheel 10 is also fixedly secured to the hub 9. The hub 9, and the cams 6 that are fixedly connected thereto as well as the fixedly held cam drive wheel 10, form a unit that by means of a bearing means 11 is rotatably mounted on a journal 12. One end of the journal 12 is held in the cylinder wall 13 of a cylinder 14 of the internal combustion engine 2. The other end of the journal 12, when the cam chamber 3 is closed off, is disposed in a recess 15 of the cam chamber cover 4.

Held in the cam chamber 3, preferably on a pivot shaft 16, are two drag levers 17, the free ends of which rest upon the cam surface 18 of the control cams 6. Supported on the free ends of the drag levers 17 are respective push rods 19, the respective other end of each of which is fixed on a rocker arm 20. For this purpose, the facing end of the rocker arm 20 is provided with a recessed portion 21 in which rests the end of the push rod 19.

The rocker arms 20 are pivotable about a pivot axis that is disposed transverse to the longitudinal axis of the rocker arm; for this purpose, between its ends the rocker arm is held on the cylinder head 24 of the cylinder 14 by means of a mounting 22. In the illustrated embodiment, the mounting 22 is embodied as a spherical mounting.

The respective other end of the rocker arm 20 actuates in a known manner poppet valves that are embodied as intake and outlet valves, and are associated with a combustion chamber 25 that is formed in the cylinder. By means of the poppet valves, the combustion chamber 25 is supplied with fresh gas or fuel, and combustion gases are also withdrawn from the combustion chamber.

For the correct control of the poppet valve 23 in terms of time, the cam drive 1 is provided, which forms the drive for the valve control. In the illustrated embodiment, the cam drive wheel 10 is embodied as a gear wheel and meshes with a driving pinion, which is fixedly disposed upon the crankshaft 26 of the internal combustion engine 2. The reduction ratio between the crankshaft and the cam drive wheel 10 determines, in conjunction with the configuration of the control cams 6, the chronologically coordinated closing and opening of the poppet valves 23.

In the illustrated embodiment, the cam chamber 3 is supplied with a fuel/air mixture, which is necessary for the lubrication of the moving parts, especially of the contact region 27 between the drag lever 17 and the cam surface 18. In the illustrated embodiment, the oil containing mixture flows via the protective conduit 28, in which the push rods 19 extend, out of the valve chamber 29 and in the direction of the arrow 30 into the cam chamber 3. In this connection, the oil-containing mixture which flows in the direction of the arrow 30, can flow through the cam chamber 3; in the illustrated embodiment, the cam chamber 3 is supplied with mixture exclusively via the protective conduit 28, which due to the pulsing pressure relationship can be adequate.

The diameter D of the cam chamber 3 (see FIG. 1) is essentially determined by the outer diameter of the cam drive wheel 10. The cams 6 themselves have a smaller diameter, whereby the necessary free space for the cams is determined by the diameter 31 of the path of the cam noses 7. In this connection, an annular chamber 33 having a maximum radial height R results between the diameter 31 and the outer peripheral wall 32 of the cam chamber 3.

Valve-controlled internal combustion engines, especially mixture lubricated engines, that are provided with such a cam drive 2 for a valve control have a cylinder displacement of approximately 30 to 150 $cm^3$, especially 20 to 80 $cm^3$. Such engines achieve speeds of 12,000 to 20,000 rpms, whereby, despite the reduction ratio between the crankshaft 26 and the cam drive wheel 10, the control cams 6 rotate in the cam chamber 3 with considerable circumferential speed. Therefore, there is formed in the cam chamber 3 a tractive flow that takes the heavy lubricating oil particles with it and displaces them outwardly.

Figure 5:
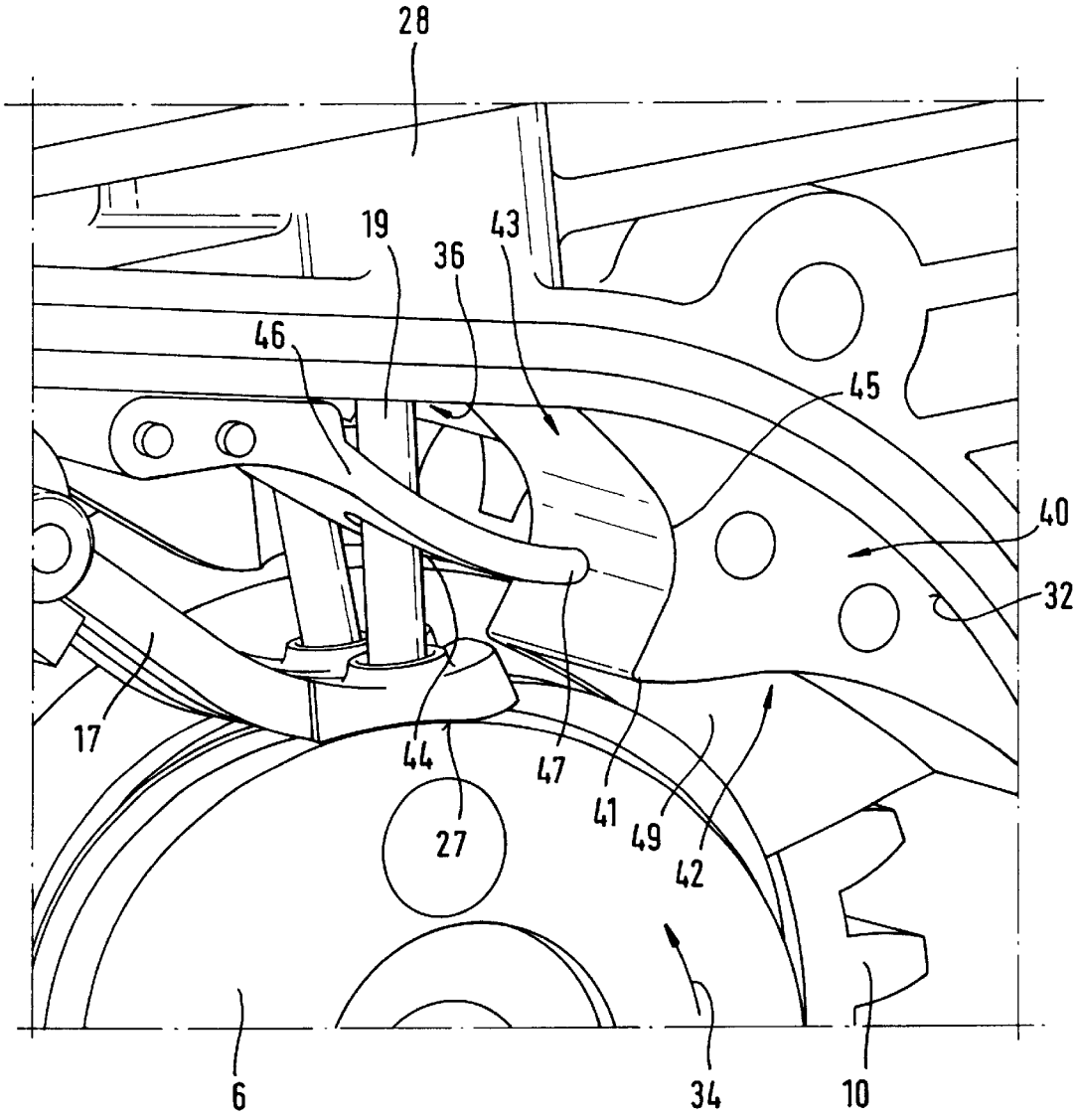
FIG. 5 is an enlarged perspective view of flow guidance elements disposed in the cam chamber.

Pursuant to the present invention, in the annular chamber 33 between the peripheral wall 32 of the cam chamber 3 and the maximum diameter 31 of the path of the cam nose 7, there is disposed a flow guidance element 40 which in FIG. 1 is illustrated only schematically by dashed lines. The flow guidance element 40 is shown in detail in FIGS. 2 to 5. For example, from FIGS. 3 and 5 it can be seen that the flow guidance element 40 is provided with a flow edge 41 that is embodied as a breakdown edge and that, in the vicinity of the diameter 31 of the path of the cam noses (see FIG. 1) is disposed adjacent to the free end of the drag lever 17. The flow guidance element 40 is disposed in the annular chamber 33 in such a way that in the direction of rotation 34 of the control cams 6, it essentially blocks the annular chamber 33. In the direction of rotation 34, the flow edge 41 of the flow guidance element 40 is thus disposed upstream of the drag lever 17, i.e. upstream of the contact region 27 of the drag lever 17 on the cam surface 18.

The flow guidance element 40 is provided with at least one deflection surface 42 or 43, which extends in a curved or arched manner from the peripheral wall 32 of the cam chamber 3 radially to the diameter 31 of the path of the cam noses. In this connection, the deflection surfaces 42 and/or 43 are disposed essentially parallel to the axis of rotation 5 of the control cams 6.

The first deflection surface 42 extends in a curved manner in the direction of rotation 34 of the control cams 6 and ends at the flow edge 41. Thus, the tractive flow that forms in the annular chamber 33 flows against the deflection surface 42, whereby when used the deflection surface 42 is disposed transverse to the tractive flow. Since the deflection surface 42 extends from the peripheral wall 32 to close to the diameter 31 of the path of the cam noses, a substantial portion of the flow is forced from the outer peripheral wall 32 to the inner flow edge 41, and hence is guided into the gap 35 between the flow edge 41 and the cam surface 18. Disposed next to the gap 35 is the end of the drag lever 17, so that the deflected tractive flow flows directly against the contact region 27 of the drag lever upon the cam surface 18. Oil particles that are carried along are in this connection deposited in the contact region 27 and an adequate lubrication is ensured. Lubricating oil that is deposited on the deflection surface 42 is forced by the tractive flow to the flow edge 41. When larger droplets have formed on the flow edge 41, they tear away and are transported by the tractive flow into the gap 35 for lubrication of the parts that move relative to one another.

Formed on that side of the flow guidance element 40 that faces away from the direction of flow is a further deflection surface 43 that is intended to deflect the oil-laden mixture stream that enters via the protective conduit 28 in the direction of the arrow 30 to the locations that are to be lubricated. The protective conduit 28 opens into the cam chamber 3 in an essentially sealed manner, whereby the flow guidance element 40 is disposed upstream of the opening 36 in the direction of flow 34. The deflection surface 43, which also extends approximately parallel to the axis of rotation 5 of the control cams 6, extends from the peripheral wall 32 to the edge of the opening 36 counter to the direction of rotation 34 relative to the flow edge 41. In so doing, the deflection surface 43 forms a flute 45 that is formed counter to the direction of rotation 34 (see FIGS. 3 and 5). The flute 45 effects a deflection of the oil laden mixture that enters via the opening 36 in a direction against the contact region 27 of the drag lever 17 on the cam surface 18. The second deflection surface 43 also ends at the flow edge 41, which is formed by the meeting or a butting deflection surfaces 42 and 43. As a result, not only is the lubricating oil that is deposited on the deflection surface 42 dislodged as drops from the flow edge 41, but rather the lubricating oil that is deposited on the deflection surface 43 also flows to the flow edge 41 due to the flow characteristics and forms drops that are to be dislodged. The flow edge 41 is thus supplied with lubricating oil from both of the deflection surfaces 42 and 43, as a result of which already after a short period of operation lubricating oil drops are dislodged in a rapid sequence from the flow edge 41 and ensure a lubrication of the moving parts of the cam drive.

In order to precisely supply the oil laden mixture that enters the cam chamber 3 essentially axially via the protective conduit 28 to the locations that are to be lubricated, a flow disruption element 46 that is disposed transverse to the protective conduit 28 is arranged ahead of the opening 36. The flow disruption element 46 is fixed in position on the peripheral wall 32 on that side of the opening 36 that is disposed across from the flow guidance element 40; the flow disruption element 46 extends in a direction toward the deflection surface 43 of the flow guidance element 40. The flow disruption element 46 is provided with through openings 44, through each of which a respective push rod 19 of the valve drive extends. It can be expedient to embody the flow disruption element 46 as a comb or rake that extends in a finger-like manner between the push rods 19. In this connection, the flow disruption element 46 is disposed in such a way that it is arranged between the drag levers 17 and the opening 36 of the protective conduit 28.

It can be expedient to embody the flow disruption element 46 in a manner similar to a ladle that extends from the peripheral wall 32 at an angle in the direction toward the flow edge 41 of the flow guidance element 40. In so doing, the lower edge 47 of the flow disruption element 46 advantageously extends into the flute 45. As a result, the axially entering flow is deflected by the laminar flow disruption element 46 in a direction toward the deflection surface 43, in particular in a direction toward the flute 45, in order by means of the deflecting function of the deflection surface 43 for the flow to be supplied via the flow edge 41 to the lubricating region. Oil that drops off at the edge 47 collects on the deflection surface 43 and is forced toward the flow edge 41, where, by being joined by other fine oil particles, it rapidly grows to oil drops that separate and pass via the deflected flow into the contact region 27.

Figure 3:
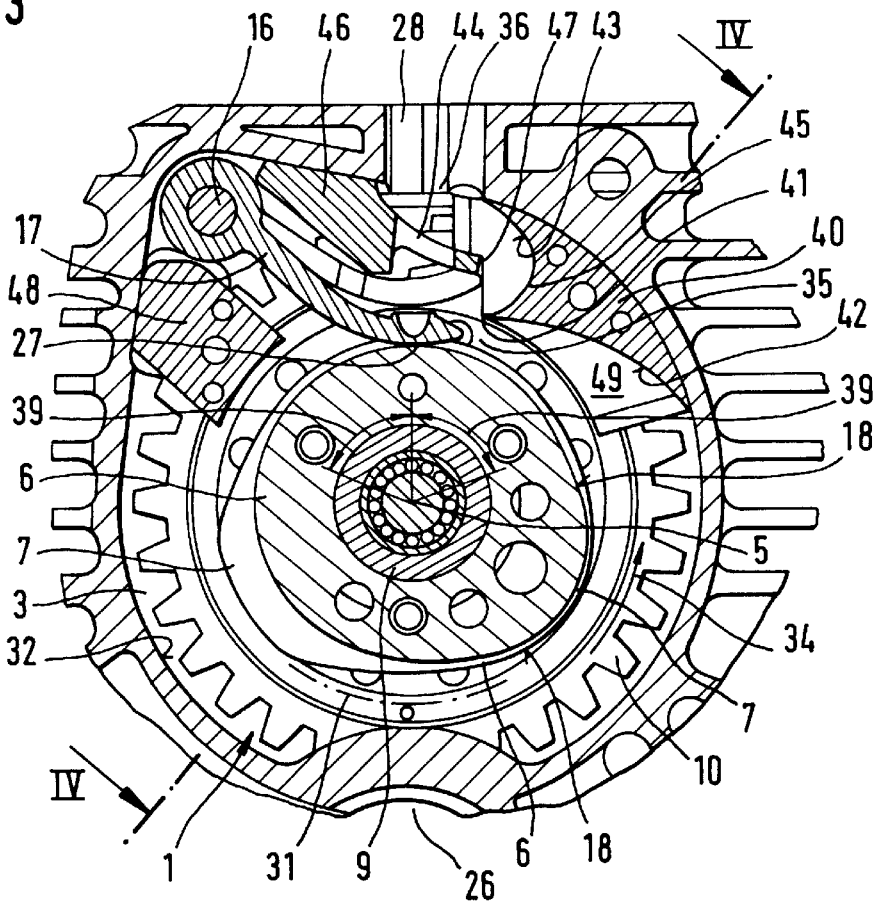
FIG. 3 is a cross-sectional view through the cam drive taken along the line III—III in FIG. 2.
Figure 4:
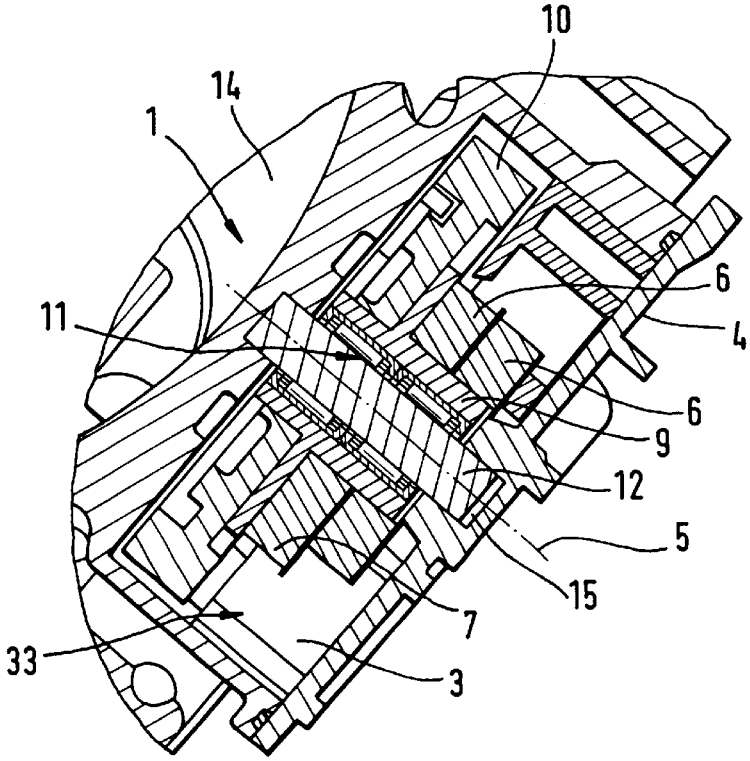
FIG. 4 is a cross-sectional view through the cam drive taken along the line IV—IV in FIG. 3.

It can be advantageous, in conformity with the illustration in FIG. 3, to dispose a flow disturbing element 48 downstream, in the direction of rotation 34 of the control cams 6, of the flow guidance element 40 and preferably also of the flow disruption element 46. The flow disturbing element 48 is provided in the annular chamber 33 between the peripheral wall 32 of the cam chamber 3 and the maximum diameter 31 of the path of the cam nose 7. In this connection, the flow disturbing element 48 has a radial length that corresponds approximately to the radial height R of the annular chamber 33. By means of the flow disturbing element 48, the oil laden mixture flow is forced to flow close to the cam surfaces 18.

To further enhance the guidance of the oil laden mixture stream in a direction toward the contact region 27, a protective wall 49 is disposed on the flow guidance element 40, with the protective wall 49 being disposed parallel to the control cams 6 and extending close to the end face of the cam drive wheel 10. The protective wall 49 has a radial height that corresponds approximately to the annular chamber 33, with the protective wall extending in the direction of rotation 34 of the control cams 6 over the entire circumferential length of the flow guidance element 40. In the illustrated embodiment the flow guidance element 40 has a maximum extension, as measured in the circumferential direction, of approximately 60°. The flow disturbing element 48 has an extension, as measured in the circumferential direction, of approximately 30°. In this way, flow guidance measures are realized over a circumferential angle 39 of approximately 50° to 90°, especially 70°, to the right and to the left of the contact region 27.

The specification incorporates by reference the disclosure of German priority document 100 43 592.0 of Sep. 1, 2000.

The present invention is, of course, in no way restricted to the specific disclosure of the specification and drawings, but also encompasses any modifications within the scope of the appended claims.

We claim:

1. A cam drive for a valve control in a valve-controlled internal combustion engine having a cylinder and a cylinder head in which is disposed a poppet valve which is actuated by a pivotable rocker arm, wherein a control cam is rotatably driven, in a cam chamber, by a crankshaft of the internal combustion engine, and wherein resting on a cam surface of said control cam is a drag lever that transfers a cam lift to said rocker arm, said cam drive further comprising:

a flow guidance element that is disposed in an annular chamber provided between a peripheral wall of said cam chamber and a maximum diameter of a path of a cam nose of said control cam, wherein a flow edge is formed on said flow guidance element, wherein said flow edge is disposed adjacent to said drag lever and in the vicinity of said path diameter of said cam nose, wherein said flow guidance element is provided with at least one deflection surface that extends in a curved manner from said peripheral wall of said cam chamber to said path diameter of said cam nose, and wherein said at least one deflection surface includes a first deflection surface that extends in the direction of rotation of said control cam and ends at said flow edge.

2. A cam drive according to claim 1, wherein said flow guidance element essentially blocks said annular chamber in a direction of rotation of said control cam.

3. A cam drive according to claim 1, wherein in a direction of rotation of said control cam said flow edge is disposed upstream of said drag lever.

4. A cam drive according to claim 1, wherein said at least one deflection surface includes a further deflection surface that ends at said flow edge and is disposed on a side of said flow guidance element that faces away from said direction of rotation of said control cam.

5. A cam drive according to claim 4, wherein said drag lever actuates said rocker arm by means of a push rod, wherein said push rod is disposed in a protective conduit that opens in an essentially sealed manner into said cam chamber, and wherein said flow guidance element ends at said opening of said protective conduit as viewed in said direction of rotation of said control cam.

6. A cam drive according to claim 4, wherein said further deflection surface begins at said opening of said protective conduit and forms a flute that is formed counter to said direction of rotation of said control cam.

7. A cam drive according to claim 6, wherein a flow disruption element is disposed transverse to said protective conduit ahead of said opening thereof into said cam chamber, wherein said flow disruption element extends into said cam chamber in a secant-like manner, and wherein said flow disruption element extends in a direction toward said flute formed by said further deflection surface.

8. A cam drive according to claim 7, wherein said flow disruption element extends into said flute.

9. A cam drive according to claim 7, wherein a push rod of the valve drive extends through said flow disruption element.

10. A cam drive according to claim 7, wherein said flow disruption element is disposed between said drag lever and said opening of said protective conduit.

11. A cam drive according to claim 7, wherein a flow disturbing element is disposed downstream of said flow guidance element as viewed in said direction of rotation of said control cam, and wherein said flow disturbing element is disposed in said annular chamber between said peripheral wall of said cam chamber and said maximum diameter of said path of said cam nose.

12. A cam drive according to claim 11, wherein said flow disturbing element is also disposed downstream of said flow disruption element.

13. A cam drive according to claim 11, wherein said flow disturbing element has a radial length that corresponds approximately to a radial height of said annular chamber.

14. A cam drive according to claim 11, wherein at least one of said flow guidance element and said flow disturbing element is provided with a protective wall that extends parallel to said control cam, wherein said protective wall is disposed in vicinity of an end face of a cam drive wheel.

15. A cam drive according to claim 14, wherein said protective wall has a radial height that corresponds approximately to that of said annular chamber, and wherein in said direction of rotation of said control cam said protective wall extends over a circumferential length of said flow guidance element.

16. A cam drive for a valve control in a valve-controlled internal combustion engine having a cylinder and a cylinder head in which is disposed a poppet valve which is actuated by a pivotable rocker arm, wherein a control cam is rotatably driven, in a cam chamber, by a crankshaft of the internal combustion engine, and wherein resting on a cam surface of said control cam is a drag lever that transfers a cam lift to said rocker arm, said cam drive further comprising:

a flow guidance element that is disposed in an annular chamber provided between a peripheral wall of said cam chamber and a maximum diameter of a path of a cam nose of said control cam, wherein a flow edge is formed on said flow guidance element, wherein said flow edge is disposed adjacent to said drag lever and in the vicinity of said path diameter of said cam nose, and wherein said flow guidance element is provided with at least one deflection surface that extends in a curved manner from said peripheral wall of said cam chamber to said path diameter of said cam nose.

17. A cam drive according to claim 16, wherein said at least one deflection surface is disposed essentially parallel to the axis of rotation of said control cam.

18. A cam drive according to claim 16, wherein said at least one deflection surface includes a first deflection surface that extends in the direction of rotation of said control cam and ends at said flow edge.

* * * * *